US005269696A

United States Patent [19]

Okada et al.

[11] Patent Number: 5,269,696

[45] Date of Patent: Dec. 14, 1993

[54] CONNECTOR ASSEMBLY

[75] Inventors: Hajime Okada; Osamu Taniuchi, both of Yokkaichi, Japan

[73] Assignee: Sumitomo Wiring Systems, Ltd., Mie, Japan

[21] Appl. No.: 944,107

[22] Filed: Sep. 11, 1992

[30] Foreign Application Priority Data

Sep. 13, 1991 [JP] Japan ..... 3-234779

[51] Int. Cl.[5] ..... H01R 13/44; H01R 13/62

[52] U.S. Cl. ..... 439/140; 439/147; 439/157; 439/160

[58] Field of Search ..... 439/140, 146, 147, 157, 439/160

[56] References Cited

U.S. PATENT DOCUMENTS 4,109,989 8/1978 Snyder, Jr. et al. ..... 439/140
4,178,051 12/1979 Kocher et al. ..... 439/157
4,605,271 8/1986 Burns ..... 439/160
4,784,610 11/1988 Stuart ..... 439/160
5,104,330 4/1992 Yagi et al. ..... 439/157
5,183,408 2/1993 Hatagishi ..... 439/147

FOREIGN PATENT DOCUMENTS 180782 5/1986 European Pat. Off. .
2179506 3/1987 United Kingdom .

*Primary Examiner*—Paula A. Bradley
*Attorney, Agent, or Firm*—Sughrue, Mion, Zinn, Macpeak & Seas

[57] ABSTRACT

A terminal member mounted in a connector is made repairable without removing a protection plate mounted in the connector while facilitating the movement of the protection plate. The protection plate is formed with jig holes close to terminal holes for allowing the terminal contact portions to penetrate therethrough. By utilizing a lever mounted to a lever type connector, the protection plate can be moved as interlocked with pivotal rotation of the lever.

3 Claims, 8 Drawing Sheets

CONNECTOR ASSEMBLY

BACKGROUND OF THE INVENTION

1. Field of the Invention

The present invention relates to a connector assembly, and more particularly to a connector assembly in which a connector has in its housing a movable protection plate for positioning and protecting the contact portions thereof protruding into an engagement opening of a counterpart connector.

2. Description of the Prior Art

Conventionally, there has been widely used a multipolar connector having not fewer than twenty poles in a wire harness for use in an automobile. In such a multipolar connector, there is provided an opening having a great area in section for receiving a counterpart connector in a housing of a connector, and many contact portions of a male terminal are protruding at certain intervals in the opening.

The contact portions of the male terminal are protruding as entirely exposed in the opening, and in practice the counterpart connector is inserted into the opening with the contact portions of the male terminal inserted in contact receiving chambers of the counterpart connector to thereby connect the male terminal with the female terminal provided in the contact receiving portions.

In the above-mentioned conventional connector, since the contact portions of the male terminal are entirely exposed in the opening, when the female terminal connector is obliquely put in contact with the male terminal connector, the contact portions may be deformed. Furthermore, since the contact portions are protruding with small intervals therebetween, the contact portions may not be aligned with the corresponding contact receiving chambers possibly abutting the contact portions to partition walls of the contact receiving chambers or possibly inserting the contact portions into other contact receiving chambers different from the corresponding ones.

In order to provide a solution to the above-mentioned problems, as shown in FIGS. 9 through 11, there has been conventionally proposed a method of providing a protection plate 4 formed with many holes 4*a* through which contact portions 3*a* penetrate in a connector receiving opening 2 of a first connector 1 for the purpose of protecting and positioning the contact portions 3*a* of a male terminal 3, and closing the opening 2 with the protection plate 4.

The protection plate 4 is, as shown in FIGS. 9 and 10, held at a forward end portion of the opening 2 by means of engagement projections 6*a* and 6*b* provided on the inner surface of a connector housing 5, and at the forward end position the tip ends of the contact portions 3*a* are protruded through the holes 4*a* of the protection plate 4.

When thrusting a counterpart (second) connector 7 into the opening 2 of the first connector 1, the protection plate 4 retreats as shown in FIG. 11 by the thrust force thereby to expose the contact portions 3*a* of the male terminal 3 and insert the contact portions 3*a* into the corresponding contact receiving chambers of the second connector 7 to thereby connect the contact portions 3*a* of the male terminal 3 with the female terminals set in the contact receiving chambers.

When inserting the male terminal 3 connected to an electric wire 8 into the connector 1 having the protection plate 4, a problem may occur in such a repair case where the male terminal 3 is inserted into an incorrect terminal chamber 5*a* and required to be reinserted into the correct terminal chamber.

In more detail, in the male terminal 3 inserted in the terminal chamber 5*a* of the connector 1, a lance section 5*b* provided protrusively in the connector housing 5 is inserted in a latch hole 3*b* formed in the male terminal 3 to be engaged with the male terminal 3, and therefore the male terminal 3 cannot be extracted from the terminal chamber 5*a* in the direction X shown in FIG. 11.

Therefore, after prying off the protection plate 4 through the opening 2 of the connector housing 5 by means of a jig tool, the lance section 5*b* must be pressed down to extract and replace the male terminal 3. In other words, the protection plate 4 behaves as an obstacle when repairing the terminal, and therefore the protection plate must be removed. After changing the terminal, the protection plate must be remounted in the connector.

Moreover, when a connector is coupled with an incorrect connector and required to be reinserted into a correct connector, it is preferred to return the protection plate to the forward position, however, generally the protection plate is not interlocked, the plate must be put back to the original position by means of a jig tool.

Furthermore, the protection plate 4 is held at the original forward end position, as shown in FIG. 9, as engaged with the engagement projections 6*a* and 6*b* provided protrusively on the inner surface of the connector housing 5 in order to protect the terminal contact portions 3*a*. Therefore, it is necessary to thrust the second connector 7 into the opening 2 of the first connector 1 so as to release the engagement between the protection plate 4 and the engagement projections 6*a* and 6*b*, and therefore a great thrust force is necessary.

In particular, when connecting a multipolar male terminal connector with the counterpart female terminal connector for use in a wire harness in an automobile, a great connecting force is necessary. The above means that, in addition to a great thrust force necessary for the second connector, an extra force for releasing the engagement between the protection plate and the projections is necessary.

Therefore, the connector has a deteriorated operability, and if the counterpart connector is thrust with a great force in an inclined direction, the connector or terminal tends to be deformed or damaged.

SUMMARY OF THE INVENTION

Accordingly, an object of the present invention is to provide a connector having a protection plate capable of easily performing a repair work such as reinsertion of a terminal.

Another object of the present invention is to improve the operability of the connector by facilitating the movement of the protection plate when receiving a counterpart connector and facilitating to return the protection plate to the forward end position after being thrust to the rearward position.

In particular, by virtue of the improvement in operability as described above in a lever type connector assembly capable of easily connecting the male terminal connector with the female terminal connector by applying a small force to the connector by means of a lever utilizing the theory of the lever, the protection plate can be moved easily and securely by utilizing the lever.

That is, by utilizing a lever rotating operation of a lever type connector, the protection plate can be moved in connection with the insertion of the connector or solely by the lever operation when the connector is not inserted.

In order to achieve the above-mentioned objects, the present invention provides a connector assembly which is made up of a first connector and a second connector to be engaged with each other and so arranged that, the first connector is provided with a male terminal whose contact portion is protruded into an opening defined in the first connector for receiving the second connector therein and that the second connector is provided with a female terminal which is connected with the male terminal of the first connector when the second connector is inserted in the opening of the first connector, the connector assembly being characterized in that, the first connector is provided with a pivotal lever having a connector guide hole formed therein and the second connector is provided with a guide pin which is inserted into the guide hole when the first and second connectors are engaged with each other, thereby pivotally rotating the lever so as to draw the second connector toward the first connector for the engagement therebetween, and that, a protection plate formed with a terminal hole through which a terminal contact portion penetrates is provided in an opening of the first connector movably in the same direction as the connector thrusting direction thereby to almost close the opening, and, by providing in the protection plate a guide pin and providing in the lever a guide groove which is engaged with the guide pin to guide the protection plate to be engaged with the guide pin, the lever is operatively made to pivot to move the protection plate as interlocked with the second connector or to move singly when the second connector is not inserted into the first connector.

Furthermore, according to a feature of the present invention, the protection plate is formed with a repairing jig hole for inserting a jig tool therein in proximity to each terminal hole, with which arrangement, when the male terminal connected to the first connector must be repaired, the protection plate is made to retreat by means of the lever to enable easy repair of the male terminal.

Furthermore, the present invention is to provide a connector assembly other than the lever type connector, wherein the connector assembly includes a protection plate having a jig insertion hole formed therein for repair in proximity to each terminal hole.

In concrete, the present invention provides a connector assembly which is made up of a first connector and a second connector to be engaged with each other and so arranged that, the first connector is provided with a male terminal whose contact portion is protruded into an opening for receiving the second connector therein and that the second connector is provided with a female terminal which is connected with the male terminal when the second connector is inserted into the opening of the first connector, the connector assembly being characterized in that, a protection plate is mounted in the opening of the first connector in which the contact portion is protruded, the protection plate being movable in the same direction as the connector thrusting direction thereby almost closing the opening, wherein the protection plate is formed with a terminal hole through which the contact portion penetrates and formed with a jig insertion hole for repair in proximity to the terminal hole.

In the present invention, since the protection plate is formed with a jig insertion hole for repair, the protection plate itself is not required to be taken out of the opening of the connector.

When the protection plate is made movable as interlocked with pivotal rotation of the lever by employing a lever type engagement structure in a connector provided with a protection plate, there is no need to move the protection plate with a force for thrusting the connector while releasing the temporary engagement of the protection plate with engagement projections, which assures a smooth operation of engagement of the connectors. Furthermore, there is no need to provide projections for the temporary engagement between the protection plate and the projections, which allows the opening to have a simple configuration.

Furthermore, in the condition where a connector exists singly without being engaged with the counterpart connector, since the protection plate can be moved by pivoting the lever in the connector, the protection plate can be made to retreat to facilitate operation of a jig tool in the repair, time and the protection plate can be easily returned back to the original position after completing the repair operation.

BRIEF DESCRIPTION OF THE DRAWINGS

These and other objects and features of the present invention will become apparent from the following description taken in conjunction with the preferred embodiment thereof with reference to the accompanying drawings, in which:

FIG. 4 (B) is a front view of the protection plate of the embodiment shown in FIGS. 1 (A) and (B);

DETAILED DESCRIPTION OF THE PREFERRED EMBODIMENTS

The following describes preferred embodiments of the present invention with reference to the attached drawings.

Figure 1:
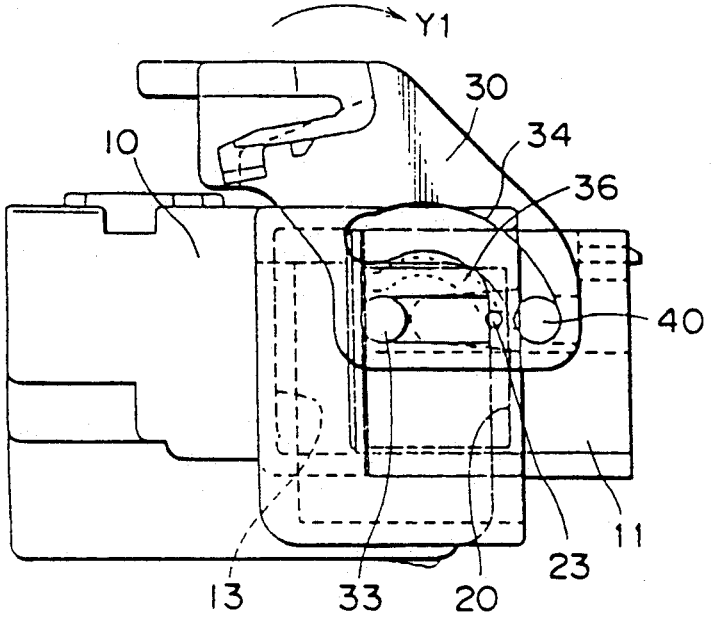
FIGS. 1 (A) and (B) are front views of a connector assembly in different engaged condition in accordance with an embodiment of the present invention.
Figure 1B:
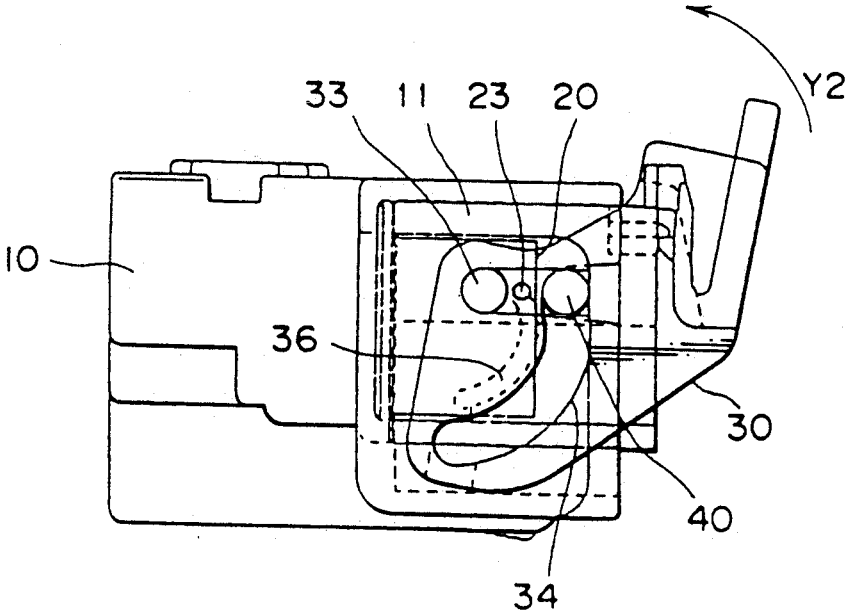

FIGS. 1 (A) and (B) show conditions where a first connector 10 is engaged with a second connector 11 each being a multipolar type connector, while FIGS. 2 through 8 show views of the first connector 10. It is noted that the same components and constructions as those in the above-mentioned conventional example are denoted by the same reference numerals.

Figure 2A:
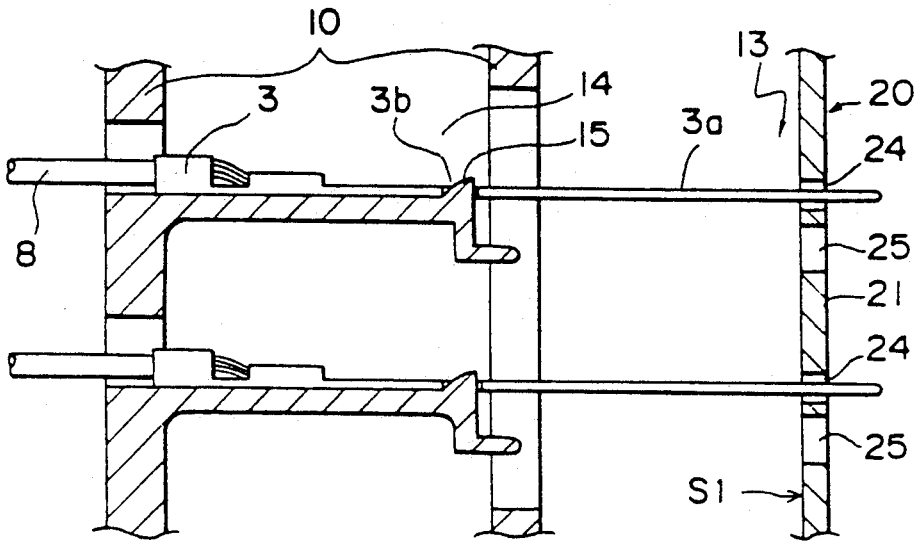
FIGS. 2 (A) and (B) are section views showing a principal portion of a protection plate in different positions in the embodiment shown in FIGS. 1 (A) and (B)
Figure 2B:
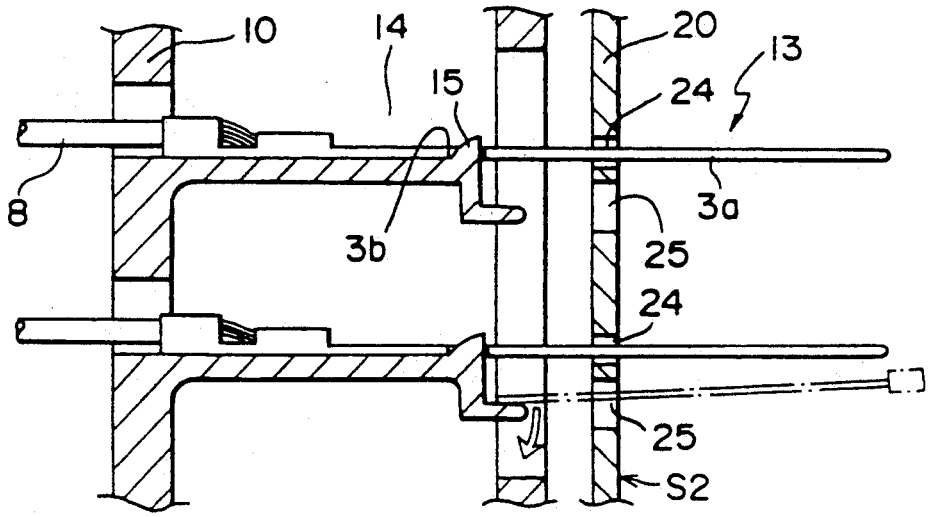

The first connector 10 is formed with an opening 13 for receiving the second connector 11 at a forward portion of a connector housing 12 and also formed with a plurality of terminal insertion chambers 14 for receiving male terminals 3 of the first connector 10 at a rearward portion in the connector housing 12 as shown in FIGS. 2 (A) and (B).

At a bottom surface of each terminal chamber 14 there is provided a lance portion 15 to be engaged with each of the male terminals 3, and each male terminal 3 inserted in the corresponding terminal chamber 14 is set with the lance portion 15 engaged with a latch hole **3*b* formed in the male terminal 3. In the above-mentioned set-up condition, the contact portion 3*a* of each male terminal 3 is protruded in the opening 13 at the forward portion in the connector housing 12**.

Figure 3:
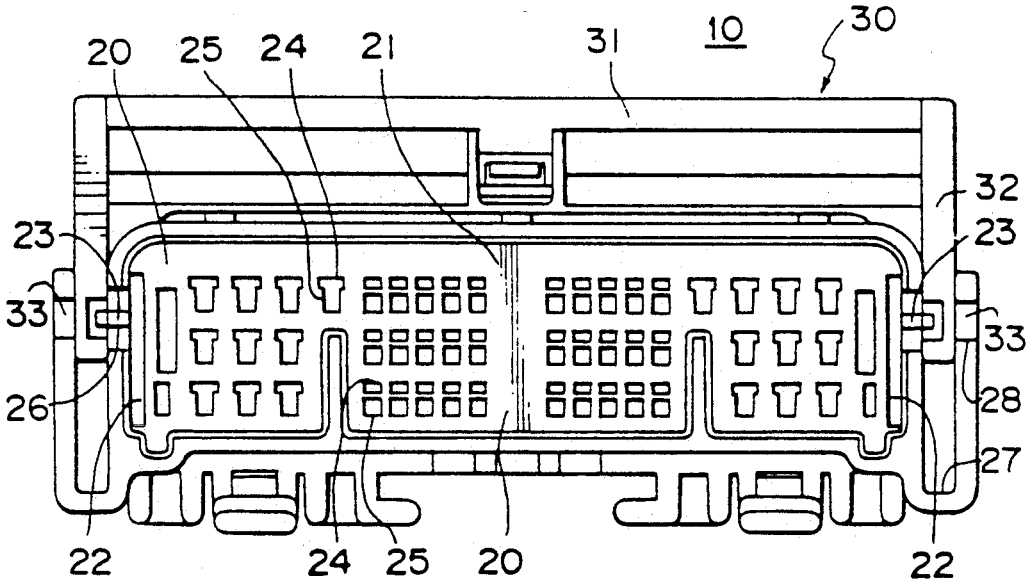
FIG. 3 is a side view of a first connector of the embodiment shown in FIGS. 1 (A) and (B)
Figure 4A:
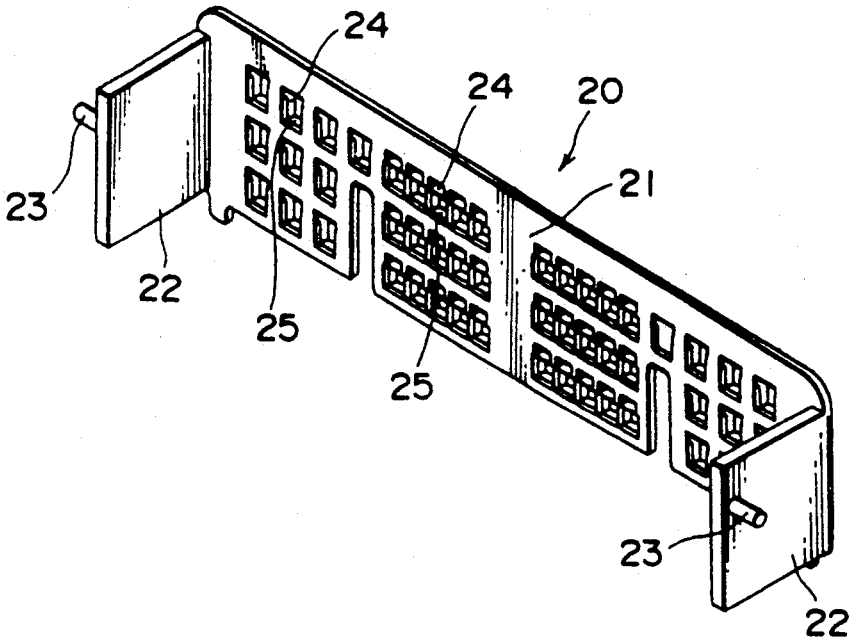
FIG. 4 (A) is a perspective view of the protection plate of the embodiment shown in FIGS. 1 (A) and (B)
Figure 4B:
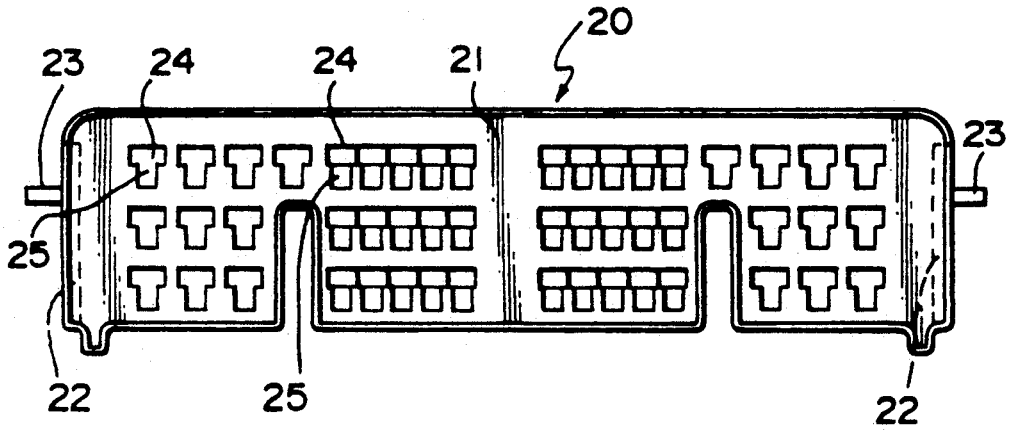

In the opening 13, as shown in FIG. 3, a protection plate 20 is placed as movable forward and reverse so as to substantially close the opening 13. The protection plate 20 has a hood-like shape comprising a closing wall 21 having the same shape in section as that of the opening 13, support portions 22 and 22 connected to both sides of the closing wall 21, and guide pins 23 and 23 each protruded from the outer surface of the support section 22.

The closing wall 21 of the protection plate 20 is formed with a plurality of terminal holes 24 for receiving the male terminals 3, while a jig insertion hole 25 is formed just below each terminal hole 24. In addition, several jig insertion holes 25 are formed downward in communication with the corresponding terminal holes 24.

The guide pins 23 provided on the right and left sides of the protection plate 20 are slidably protruded passing through guide holes 26 formed depth-wise in the right and left side walls of the opening 13 in the connector housing 12. The guide pins 23 can be moved depth-wise along the guide holes 26, where the protection plate 20 has its foremost end position at an original position S1 as shown in FIG. 2 (A) and its rearmost end position at a counterpart connector receiving position S2 as shown in FIG. 2 (B).

The tip end portions of the guide pins 23 of the protection plate 20 are slidably engaged in a plate guide groove 36 formed in a lever 30 which is mounted on the right and left external walls of the opening 13 as shown in FIGS. 1 (A) and (B), and in accordance with pivotal rotation of the lever 30, the tip end portions of the guide pins 23 are moved between the foremost end position S1 and the rearmost end position S2.

Figure 5A:
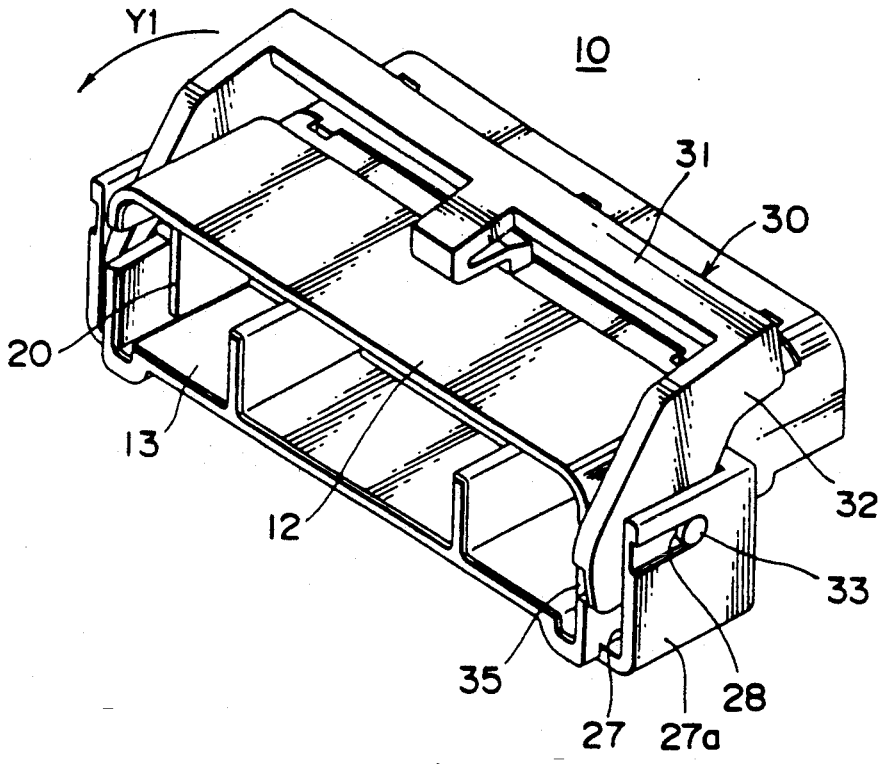
FIGS. 5 (A) and (B) are perspective views of a first connector in different conditions in the embodiment shown in FIGS. 1 (A) and (B)
Figure 5B:
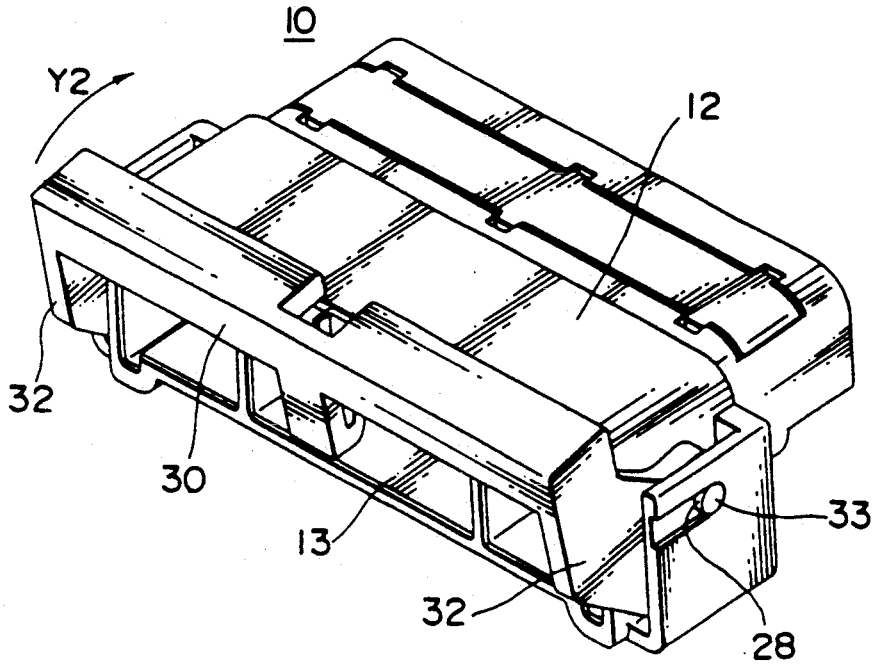

Referring to FIGS. 5 (A) and (B), the lever 30 has a hood-like shape comprising a center portion 31 having right and left side portions 32 integrally connected thereto and support pins 33 provided protrusively on the both side portions 32, and the lever 30 is inserted with a space in lever receiving portions 27 defined between the outer surfaces of the right and left side walls of the connector housing 12 and outer wall portions **27*a* with the support pins 33 inserted in pin support holes 28 formed in the outer wall portions 27*a* to rotatably support the pins 33**.

Figure 6:
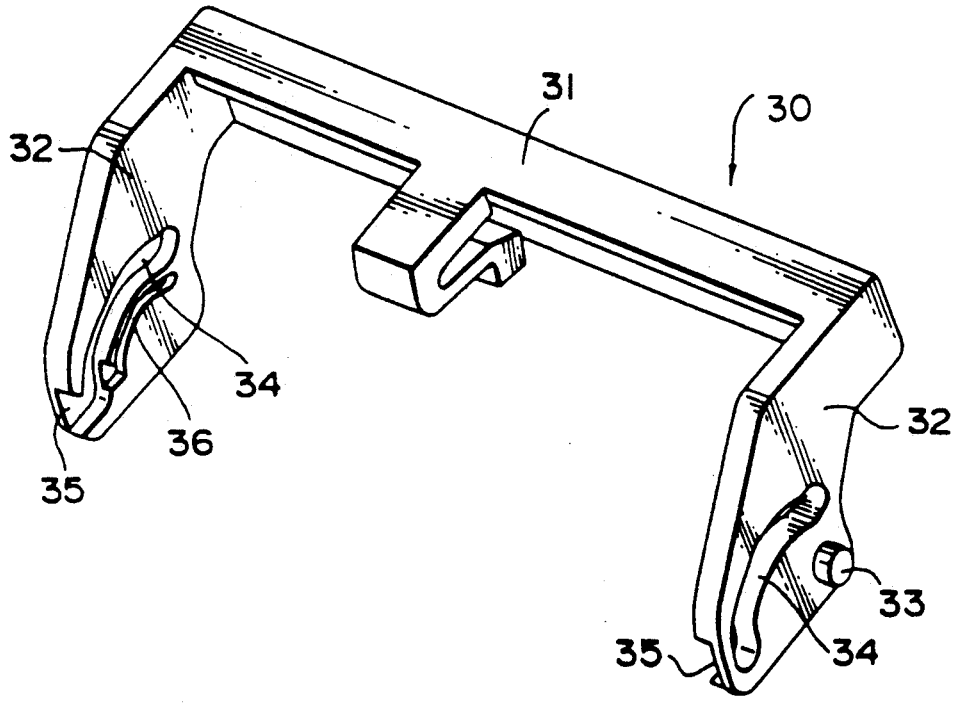
FIG. 6 is a perspective view of the lever in accordance with the embodiment shown in FIGS. 1 (A) and (B)
Figure 7:
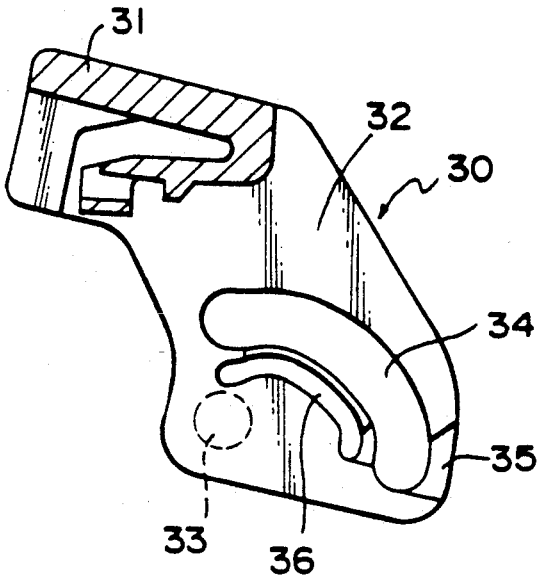
FIG. 7 is a partially sectional side view of the lever in accordance with the embodiment shown in FIGS. 1 (A) and (B)

Referring to FIGS. 6 and 7, in the right and left side portions 32 of the lever 30, there are formed arcuate connector guide holes 34 and inward guide grooves 35 continuously from the fore ends of the connector guide holes 34. The guide grooves 35 and the connector guide holes 34 are so arranged that, when a second connector 11 is thrust into the opening 13 of the first connector 10, guide pins 40 provided on the right and left outer surfaces of the second connector 11 are inserted in the connector guide holes 34 (see FIG. 1).

On the inner surfaces of the right and left side portions 32 of the lever 30, there are provided plate guide grooves 36 along the inner circumference of the connector guide holes 34, each groove 36 having the same curvature as that of the arcuate connector guide hole 34. The guide pins 23 provided on the protection plate 20 are slidably engaged with the plate guide grooves 36.

With the construction of the connector as described above, when the first connector 10 exists single, i.e., before it is engaged with the second connector 11, the lever 30 in a condition as shown in FIG. 5 (A) is placed near the terminal chambers 14 where the lower surface of the center portion 31 is temporarily engaged with a locking portion (not shown) provided protrusively on the upper surface of the connector housing 12.

When the lever 30 is in the temporary engagement position, the guide pins 23 of the protection plate 20 engaged with the plate guide grooves 36 of the lever 30 are placed in the foremost end positions of the plate guide grooves 36 as shown in FIG. 1 (A), while the protection plate 20 is held in the foremost end position S1 located slightly inward from the edge of the opening 13 as shown in FIG. 2 (A) and FIG. 5 (A). In this condition, the fore end of the contact portion **3*a* of each male terminal 3 is slightly protruding from the terminal hole 24 of the protection plate 20**.

With the above construction, almost the entire contact portion **3*a* is not exposed but placed inside the opening 13 covered with the protection plate 20** so as to be protected from any external force.

When connecting the first connector 10 with the second connector 11, firstly the second connector 11 is thrust into the opening 13 of the first connector 10 as shown in FIG. 1 (A). By thrusting the second connector 11 into the opening 13, the guide pins 40 provided on the second connector 11 are inserted through the guide grooves 35 into the foremost end of the connector guide holes 34 of the lever 30.

When thrusting the second connector 11 into the first connector 10, the tip end portion of each contact portion **3*a* protruding through the protection plate 20 is inserted into the corresponding terminal chamber provided in the second connector 11. In the above case, since the position of each contact portion 3*a* is regulated by the terminal holes 24 formed in the protection plate 20, the contact portions 3*a* are not inserted into the contact receiving chambers unless the second connector 11 is thrust in the correct direction, which assures the alignment between the contact portions 3*a*** and the corresponding terminal chambers.

After thrusting the second connector 11 into the first connector 10, the lever 30 is pivotally rotated around the support pins 33 in the direction Y1 as shown in FIG. 1 (A) to be put into the position as shown in FIG. 1 (B).

In accordance with the pivoting of the lever 30, the connector guide holes 34 and the plate guide grooves 36 formed in the lever 30 are also turned. Since the depthwise movement of the guide pins 40 of the second connector 11 and the guide pins 23 of the protection plate 20 are regulated by the connector guide holes 34 and the plate guide grooves 36 with which they are engaged respectively, the guide pins 40 of the second connector 11 and the guide pins 23 of the protection plate 20 are compulsorily moved into the opening 13 in accordance with the pivotal rotation of the lever 30 in the direction Y1.

Thus, the protection plate 20 and the second connector 11 are moved deep into the opening 13 in an interlocked manner. With the movement of the protection plate 20, each contact portion 3*a* protruding from the protection plate 20 is inserted into the corresponding terminal insertion chamber of the second connector 11 thrust into the opening 13 to make contact with the contact portion of the female terminal provided in the terminal insertion chambers. The guide pins 40 and 23 moving respectively in the connector guide holes 34 and the plate guide grooves 36 stop at the rearmost end position S2 as shown in FIG. 2 (B), where the male terminal 3 can be completely mated with the female terminal.

As described above, in the preferred embodiment, when the first and second connectors 10 and 11 are engaged with each other, simultaneously with making the protection plate 20 retreat by pivoting the lever 30, the second connector 11 is thrust into the opening. As described above, since the protection plate 20 is moved from the temporary engagement position by pivoting the lever 30 for thrusting the connector, there is no need for a great force for releasing the protection plate 20 from the temporary engagement position, nor for any means for locking the protection plate 20 in the temporary engagement position.

When it is found that a terminal of the first connector is inserted in an incorrect terminal chamber in the second connector after the first and second connectors are engaged with each other and there is a need for reengagement, the lever 30 shall be made to pivot in the reverse direction Y2. With pivoting the lever 30 in the reverse direction, the protection plate 20 and the second connector 11 are compulsorily moved in directions reverse to the above-mentioned movement directions to be put back into the original position as shown in FIG. 1 (A).

The second connector 11 put back to its original position can be easily pulled out of the opening 13. Therefore, when an incorrect terminal is inserted in the second connector 11, it is easy to change the terminal.

With operating the lever 30, the protection plate 20 is put back to its original position together with the second connector 11.

When a male terminal is inserted into an incorrect terminal chamber of the first connector 10 in which the protection plate 20 is mounted, since the protection plate 20 is put back to the original position as described above, it is necessary to insert a jig tool through the jig hole insertion 25 formed in the protection plate 20 placed apart from the lance portion 15, which results in a degraded operability.

Therefore, the lever 30 in the condition shown in FIG. 5 (A) is put into the condition as shown in FIG. 5 (B) by pivoting the lever 30 in the direction Y1 independently in the same manner as thrusting the second connector.

With pivoting the lever 30, the protection plate 20 is moved into the rearmost end position as shown in FIG. 2 (B) to put the jig insertion hole 25 of the protection plate 20 closer to the lance portion 15, which facilitates easy operation of pressing down the lance portion 15 by means of a jig 41 inserted through the jig insertion hole 25.

By pressing down the lance portion 15 by means of the jig 41 to release the lance portion 15 from the latch hole 3*b* of the male terminal 3 and pulling an electric wire 8 connected to the male terminal 3, the male terminals 3 can be easily extracted from the first connector 10.

By pivoting the lever 30 in the direction Y2 after replacing the terminal, the protection plate 20 can be put in the foremost end position (original position) to protect the male terminals in the condition that the connector exists alone before being combined with the counterpart connector.

Although the above-mentioned embodiment is a combination of a lever type connector and a protection plate, the present invention is not limited to the above-mentioned lever type connector.

Figure 8:
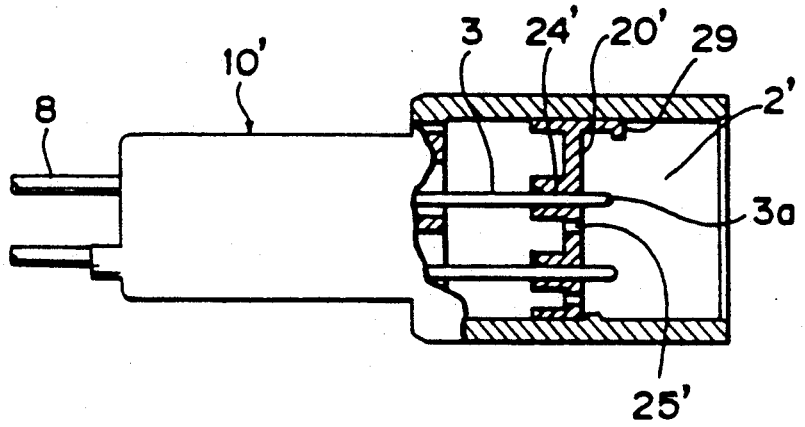
FIG. 8 is a partially sectional front view of the first connector in accordance with a modified example of the present invention.

For example, in a modified example as shown in FIG. 8, as far as a protection plate 20' is mounted in an opening 2' of a first connector 10' where male terminals 3 are received, by providing a jig hole 25' adjacent to a terminal holes 24' in the protection plate 20, the repairing capability of the male terminals 3 can be improved. It is noted that the protection plate 20' of the modified embodiment is provided with a hook portion 29 to be engaged with a jig.

Figure 9:
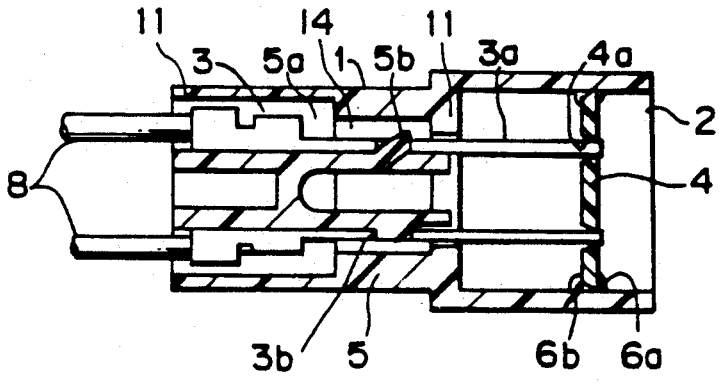
Fig. 9 (Prior Art)
FIG. 9 is a section view of a conventional connector.
Figure 10:
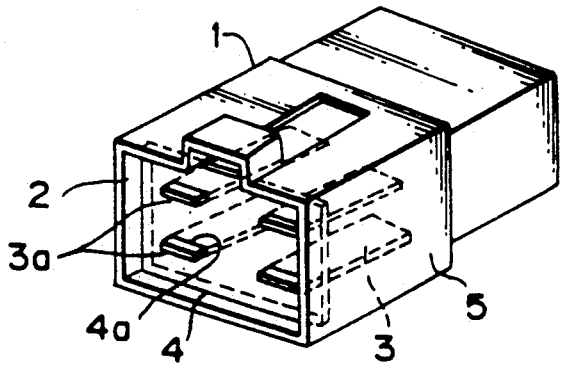
Fig. 10 (Prior Art)
FIG. 10 is a perspective view of the connector shown in FIG. 9.
Figure 11:
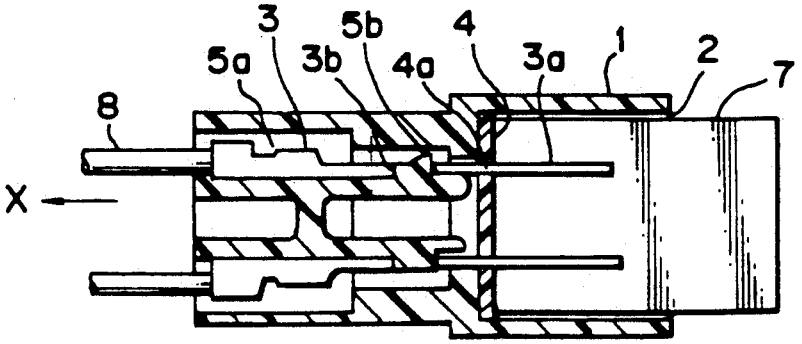
Fig. 11 (Prior Art)
FIG. 11 is a section view of the connector shown in FIG. 9 when engaged with the counterpart connector.

The protection plate 20' is temporarily engaged with projections (not shown) provided on the inner surface of an opening 2' in the same manner as that with projections 6*a* and 6*b* in the conventional one (see FIG. 9). When repairing the connector, the protection plate 20' itself is thrust deep inside by means of a jig to put the protection plate 20' close to the lance portion. By pressing down the lance portion and inserting the jig through the jig insertion hole 25' in the same manner as in the previous embodiment, the male terminal can be changed.

By hooking a jig tool to the hook portion 29 after changing the male terminal, the protection plate 20' can be easily put back to the original position.

According to the present invention described as above, since a jig insertion hole for repair purpose is formed in the protection plate, there is no need to remove the protection plate in the repair time.

Furthermore, when the protection plate is moved as interlocked with operating the lever for connector engagement, the protection plate can be made to retreat by pivoting the lever in the repair time, which also assures a good operability. After completing a repair work, the protection plate can be easily put back to its original position by pivoting the lever.

Although the present invention has been fully described by way of example with reference to the accompanying drawings, it is to be noted here that various changes and modifications will be apparent to those skilled in the art. Therefore, unless otherwise such changes and modifications depart from the scope of the present invention as defined by the appended claims, they should be construed as included therein.

What is claimed is:

1. A connector assembly which is made up of a first connector and a second connector to be engaged with each other, said first connector comprising:

one or more male terminals of which each contact portion is protruded into an opening defined in said first connector for receiving said second connector therein, each of said male terminals being connected with each female terminal provided in said second connector when said second connector is inserted in the opening of said first connector;

lever means pivotally rotatable around a pair of guide pins (33), having connector guide holes (34) formed therein for inserting a pair of guide pins (40) provided in said second connector when said first and second connectors are engaged with each other, thereby pivotally rotating said lever means so as to draw said second connector toward said first connector for the engagement therebetween;

a protection plate formed with one or more terminal holes through which terminal contact portions of said male terminals are penetrated, said protection plate being located in the opening of said first connector movably in the same direction as that of thrusting said second connector thereby to substantially close the opening, wherein said protection plate is provided with a pair of guide pins (23) which are engaged with guide grooves (36) formed in said lever means to guide the protection plate, and wherein said lever means is operatively made to pivot to move the protection plate as interlocked with the second connector when combined with said first connector and to move the protection plate independently when said second connector is not combined with said first connector.

2. The connector assembly as claimed in claim 1, wherein said protection plate is formed with one or more jig holes for repair in proximity to the terminal holes (24).

3. A connector assembly which is made up of a first connector and a second connector to be engaged with each other and so arranged that, the first connector is provided with one or more male terminals whose contact portions are protruded into an opening formed in said first connector for receiving said second connector therein and that said second connector is provided with one or more female terminals which are connected with the male terminals when said second connector is inserted into the opening of said first connector, the connector assembly comprising:

a protection plate mounted in the opening of said first connector in which the contact portions of said first connector are protruded, the protection plate being movable in the same direction as the direction of thrusting said second connector thereby substantially closing the opening, wherein said protection plate is formed with terminal holes through which the contact portions are penetrated and formed with jig insertion holes for repair in proximity to the terminal holes.

* * * * *